US011959273B1

(12) United States Patent
Xiang et al.

(10) Patent No.: US 11,959,273 B1
(45) Date of Patent: Apr. 16, 2024

(54) DAMAGE-FREE ENGAGEMENT DEVICE FOR ENHANCED WIND-RESISTANCE OF BASE-ISOLATED STRUCTURES

(71) Applicant: Tongji University, Shanghai (CN)

(72) Inventors: Yang Xiang, Shanghai (CN); Kui Yuan Xu, Shanghai (CN); Guo Qiang Li, Shanghai (CN)

(73) Assignee: Tongji University, Shanghai (CN)

( * ) Notice: Subject to any disclaimer, the term of this patent is extended or adjusted under 35 U.S.C. 154(b) by 5 days.

(21) Appl. No.: 18/352,217

(22) Filed: Jul. 13, 2023

(30) Foreign Application Priority Data

Jan. 10, 2023 (CN) ..... 202310035365.7

(51) Int. Cl.
*E04B 1/98* (2006.01)

(52) U.S. Cl.
CPC ..... *E04B 1/98* (2013.01)

(58) Field of Classification Search
CPC ..... E04B 1/98; E04H 9/021; E04H 9/0215; E04H 9/0235; E04H 9/14; E04H 9/16
See application file for complete search history.

(56) References Cited

U.S. PATENT DOCUMENTS 4,527,365 A * 7/1985 Yoshizawa ..... F16F 7/08 52/167.8
4,991,366 A * 2/1991 Teramura ..... E04H 9/0235 188/313
5,125,761 A * 6/1992 Cullen ..... F16B 2/18 403/314
8,641,282 B2 * 2/2014 Chuang ..... F16C 29/02 384/36
8,789,319 B2 * 7/2014 Li ..... E04H 9/0237 267/136
9,856,670 B1 * 1/2018 Kraft ..... E06B 3/4636
11,339,849 B2 * 5/2022 Zhou ..... F16F 15/022
2013/0148917 A1 * 6/2013 Chuang ..... F16C 29/02 384/36
2014/0041320 A1 * 2/2014 Li ..... E04H 9/0237 52/167.3
2021/0301900 A1 * 9/2021 Zhou ..... F16F 15/022
2022/0290457 A1 * 9/2022 Yang ..... F16F 7/08

* cited by examiner

*Primary Examiner* — Rodney Mintz
(74) *Attorney, Agent, or Firm* — Idea Intellectual Limited; Margaret A. Burke; Sam T. Yip

(57) ABSTRACT

The present invention relates to a damage-free engagement device for wind-resistance of base-isolated structures. It includes a rubber seismic isolation support, upper and lower connecting plates, and a wind-resistance stiffness adjuster. The adjuster comprises a horizontal sliding bearing plate, a vertical guide groove, and components within the guide groove. These components include a bird beak plate, a disc spring group, and a stiffness adjustment bolt. The bird beak plate slides along the guide groove and engages with the sliding bearing plate. The invention improves horizontal stiffness while maintaining seismic isolation. It achieves a "wind lock-seismic unlock-wind lock" mechanism without component replacement, reducing maintenance costs.

8 Claims, 10 Drawing Sheets

DAMAGE-FREE ENGAGEMENT DEVICE FOR ENHANCED WIND-RESISTANCE OF BASE-ISOLATED STRUCTURES

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCES WITH RELATED DOCUMENTS

The present application claims priority to CN Patent Application No. 202310035365.7 filed Jan. 10, 2023; the disclosure of which is incorporated herein by reference in its entirety.

FIELD OF THE INVENTION

The present invention relates to the technical field of wind-resistant and seismic-resistant building structures, particularly to a damage-free engagement device for enhanced wind-resistance of base-isolated structures.

BACKGROUND OF THE INVENTION

Seismic isolation technology is an effective way to reduce the damage caused by earthquakes to building structures, and to provide full protection on human life and property. In recent years, it has been widely used in construction. The basic principle of seismic isolation technology is to install isolation bearings with lower horizontal stiffness in the seismic isolation layer, which prolongs the natural vibration period of the structure, and reduces the seismic response of the super-structure. Therefore, theoretically, an isolation layer with a lower horizontal stiffness would yield a better isolation effect.

In the design of seismic isolation, the horizontal stiffness of the seismic isolation layer should be minimized to fully utilize the isolation performance of the seismic isolators, provided that the relevant codes and standards are met. However, when the seismic isolation structure needs to withstand large wind loads (such as in areas with high wind loads, high-rise buildings or wind-sensitive structures), excessively low stiffness of the seismic isolation layer may lead to excessive floor acceleration response under wind load, resulting in discomfort issues during wind loading.

In order to meet the wind-comfort requirements of the seismic isolation structures, the conventional technology generally resort to an increased horizontal stiffness of the seismic isolation layer. This method to some extent reduces the functional advantages of the seismic isolation structure and cannot achieve the maximum "horizontal earthquake isolation" function, thereby reducing the seismic isolation efficiency of the structure.

In order to address the conflict between the flexibility demand for seismic isolation and the stiffness demand for wind-induced vibration-resistance in seismic isolation structures, it is necessary to add wind resistance units in the seismic isolation layer to: 1) provide additional stiffness under wind load, 2) withdraw from operation under medium and large earthquakes and ensure the complete release of the flexibility of the seismic isolation layer. To date, the wind resistance devices added to existing seismic isolators have various defects, such as the non-adjustable additional stiffness, the complex structural configuration which is difficult to maintain, the inability to switch automatically from a "wind-resistance locked" to a "seismic isolation unlocked" state, and the possible plastic damages of components under large earthquake actions.

SUMMARY OF THE INVENTION

The purpose of the present invention is to provide a damage-free engagement device for enhanced wind-resistance of base-isolated structures to overcome the defects in the prior arts.

The purpose of the present invention can be achieved by the following technical solution:

The technical solution of the present invention is to provide a damage-free engagement device for enhanced wind-resistance of base-isolated structures, which includes:

A rubber seismic isolation support is placed between the super-structure and the sub-structure of a seismic isolation layer. The support has an upper and a lower surface, each equipped with a connecting plate that links the super-structure and the sub-structure of the seismic isolation layer.

A group of wind-resistance stiffness adjusters are disposed between the upper connecting plate and the lower connecting plate. These wind-resistance stiffness adjusters surround the rubber seismic isolation support. The wind-resistance stiffness adjuster includes a horizontal sliding bearing plate fixed on the upper connecting plate, a vertical guide groove disposed on the lower connecting plate, and components arranged within the vertical guide groove. The components in the vertical guide groove include a bird beak plate and a disc spring group in sequence from top to bottom. The bird beak plate is able to slide up and down along the vertical guide groove, and an upper hook structure of the bird beak plate fits and hooks with the horizontal sliding bearing plate.

In which the seismic isolation support is a commercially available product commonly used for building seismic isolation.

In a further embodiment, the bird beak plate has a comma-shaped structure, and comprises a circular structure and an upper hook structure integrated with the circular structure, and the horizontal sliding bearing plate has an L-shaped structure, and comprises a horizontal bar and protrusions located at an end of the horizontal bar, and the upper hook structure of the bird beak plate engages with and hooks onto the protrusions of the horizontal sliding bearing plate.

In a further embodiment, when the upper hook structure of the bird beak plate engages and hooks onto the protrusions of the horizontal sliding bearing plate, an interface between them forms an inclined slope surface.

In a further embodiment, wherein a central part of the circular structure of the bird beak plate has a hole through which a horizontal connecting rod passes to connect the plurality sets of wind-resistance stiffness adjusters set side by side.

In a further embodiment, two side walls of the vertical guide groove are non-equal in length and comprise a longer side wall and a shorter side wall, and the highest point of the longer side wall is lower than the lowest point of the horizontal sliding bearing plate.

In a further embodiment, the longer side wall further fits slidingly with the upper hook structure of the bird beak plate, and the shorter side wall fits slidingly with the circular structure of the bird beak plate.

In a further embodiment, upper and lower surfaces of the disc spring group disposed with an upper steel washer and a lower steel washer, the upper steel washer is in contact with a bottom of the bird beak plate, and the lower steel washer is equipped with a stiffness adjustment bolt to adjust a compression state of the disc spring group.

In a further embodiment, the stiffness adjustment bolt comprises a bolt end plate positioned on the vertical guide groove, a bolt fixed to the bolt end plate, and a washer and a nut threaded sequentially through the bolt from top to bottom.

In a further embodiment, a center of the lower steel washer has a hole, allowing the bolt to pass through the lower steel washer.

In a further embodiment, when the bolt passes through the lower steel washer to secure the stiffness adjustment bolt to the disc spring group, the washer further fits against the lower steel washer, and the bolt end plate fits against the bottom of the vertical guide groove.

Compared with the prior art, the present invention has the following beneficial effects:

(1) The disc spring group and the bird beak plate in the wind stiffness adjuster of the present invention provide horizontal stiffness when they are engaged and hooked with the horizontal sliding plate. Such a configuration enables the seismic isolation layer to resist the horizontal shear forces induced by wind loads and addresses the issue of excessive horizontal stiffness in conventional designs that consider wind-induced vibrations. It effectively solves the wind comfort problem in seismic isolation structures.

(2) Under seismic action, the bird beak plate in the present invention experiences horizontal thrust, compressing the disc spring group and causing it to disengage from the horizontal sliding plate. As a result, the wind stiffness adjuster ceases to function and no longer restricts the horizontal displacement of the seismic isolation layer, allowing the flexibility of the rubber seismic isolation support to fully manifest. The disengaged wind stiffness adjuster does not affect the isolation effect of the rubber seismic isolation support, eliminating the need for specific design reevaluation of the wind seismic isolation layer under seismic conditions and avoiding additional burden on the seismic isolation structure.

(3) The wind stiffness adjuster in the present invention is designed to be detachable. After an earthquake, the stiffness adjustment bolt can be rotated to release the pressure on the disc spring group. Then, the bird beak plate can be manipulated to re-engage an upper hook structure thereof with the horizontal sliding plate. Finally, the stiffness adjustment bolt is tightened again to quickly restore the working state of the wind stiffness adjuster. The entire process is simple to operate, does not require components replacement, has low reset difficulty, high working efficiency, and avoids frequent replacement of wind isolation supports, significantly reducing maintenance costs.

(4) The entire force transmission path of the "wind lock-isolation unlock-wind lock" mechanism in the present invention is clear. Moreover, the invention has a simple structure, easy installation, high safety and reliability, superior performance stability, and broad prospects for application.

1—Upper connecting plate
2—Lower connecting plate
3—Horizontal sliding bearing plate
4—Rubber seismic isolation support
5-1—First connecting bolt
5-2—Second connecting bolt
6—Bird Beak plate
7—Vertical guide groove
8—Horizontal link rod
9—Stiffness adjustment bolt
9-1—Bolt end plate
9-2—Bolt rod
9-3— Washer
9-4— Nut
10—Disc spring group
11—Upper steel washer
12—Lower steel washer
13-1—First anchor bolt
13-2—Second anchor bolt

DETAILED DESCRIPTION

The following detailed description of the present invention is provided in conjunction with the accompanying drawings and specific embodiments.

In the following embodiments, unless otherwise specified, functional components or structures not specifically mentioned are considered to be conventional components or structures commonly used in the field for achieving their respective functions.

Embodiment 1

Figure 1:
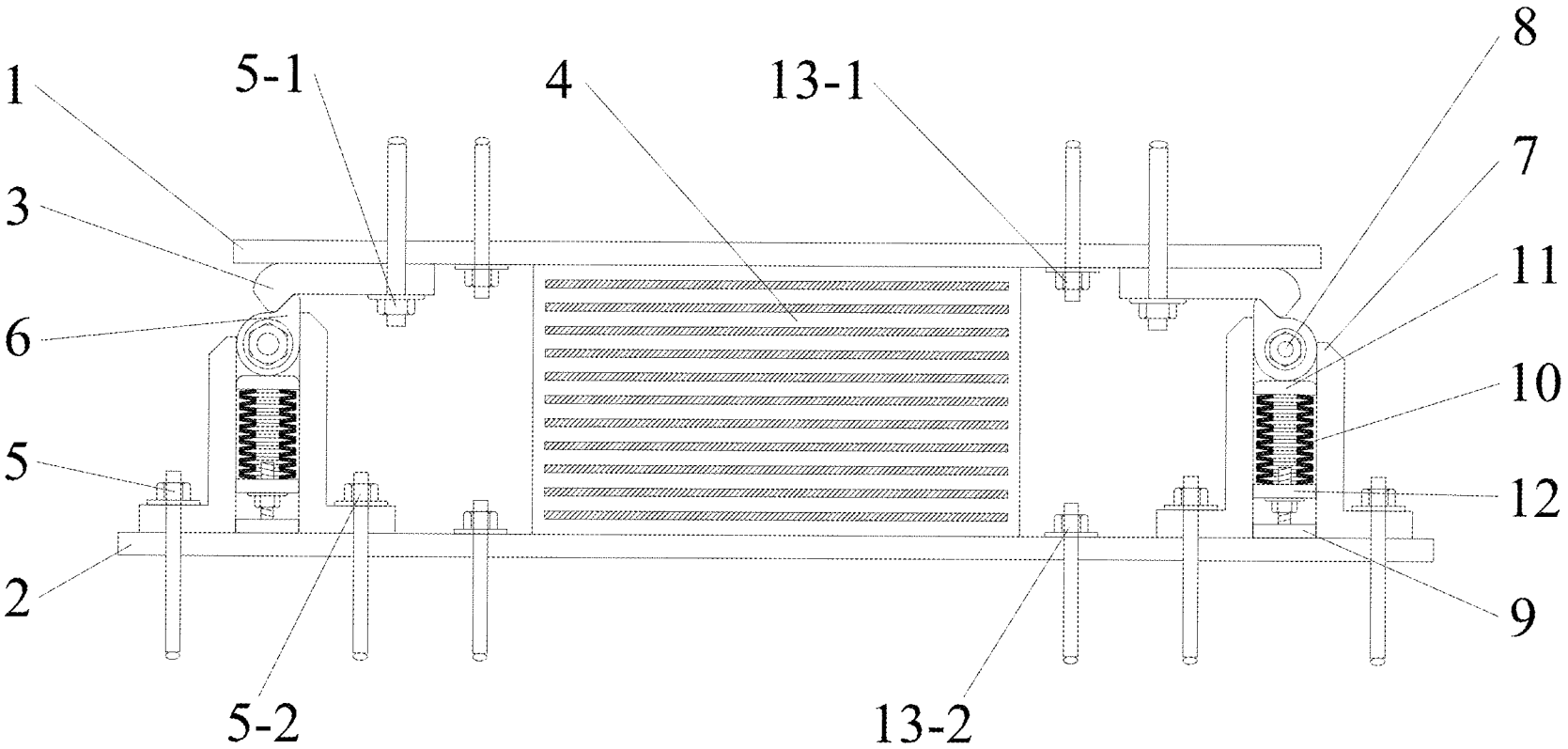
FIG. 1 depicts a front view of the structure of the present invention.
Figure 2:
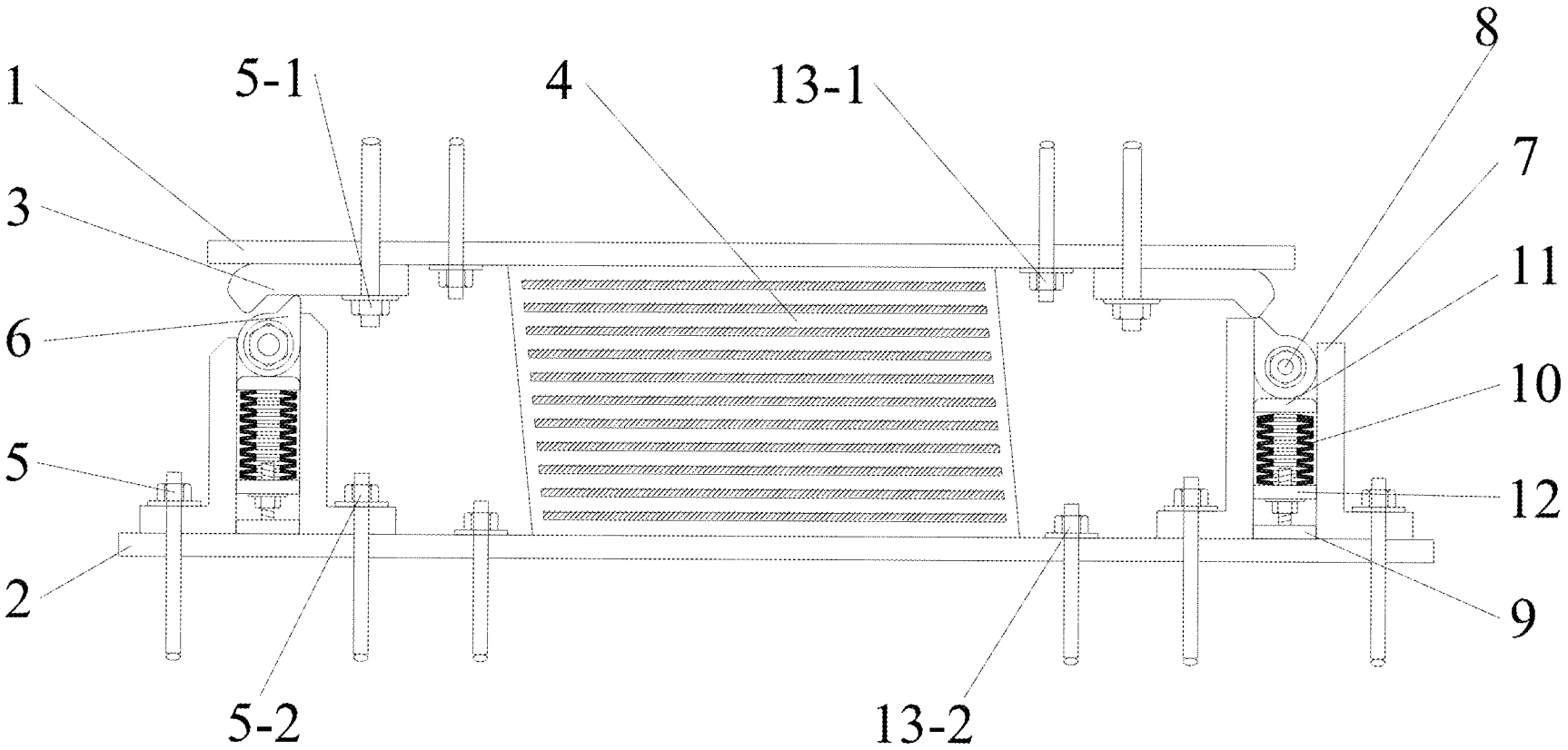
FIG. 2 depicts a schematic diagram of the structure of the present invention in a disengaged state.
Figure 3:
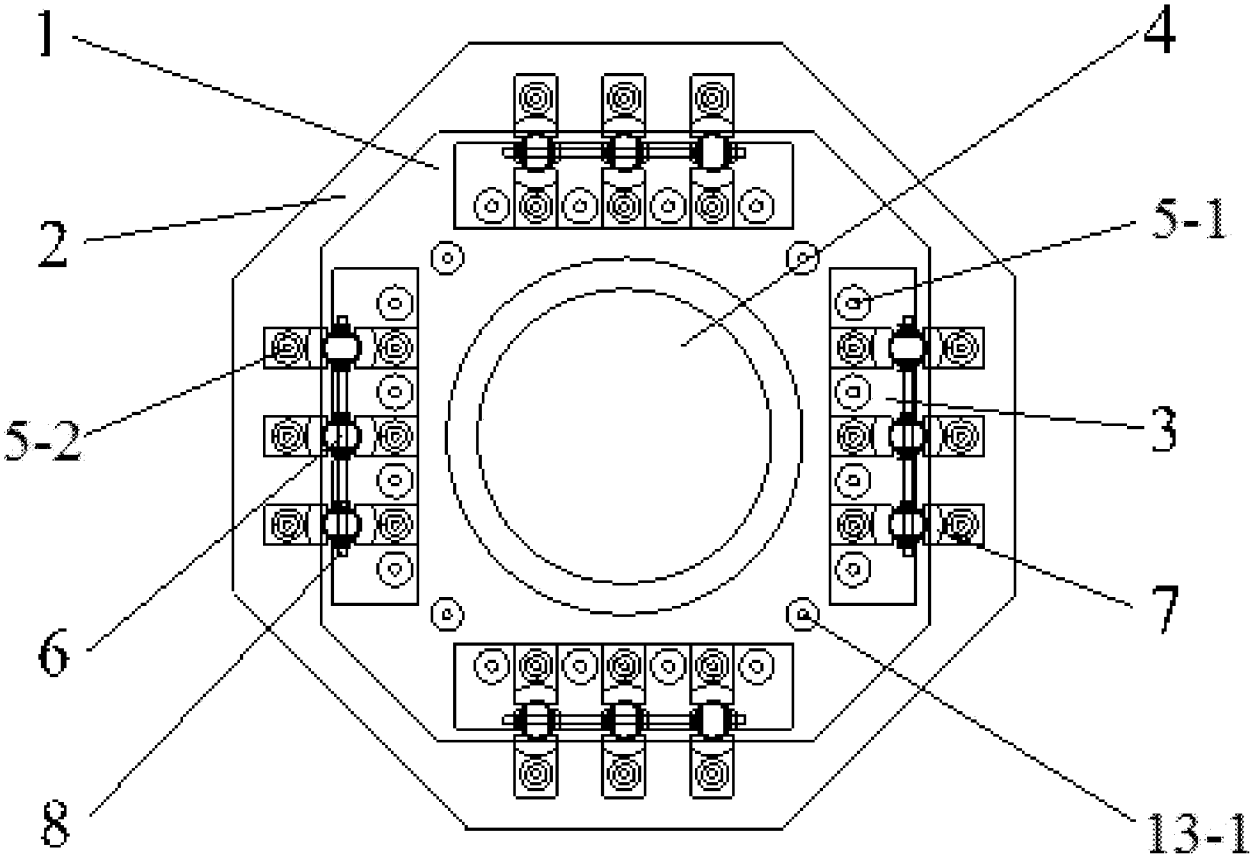
FIG. 3 depicts a top-down view schematic diagram of the structure of the present invention.
Figure 4:
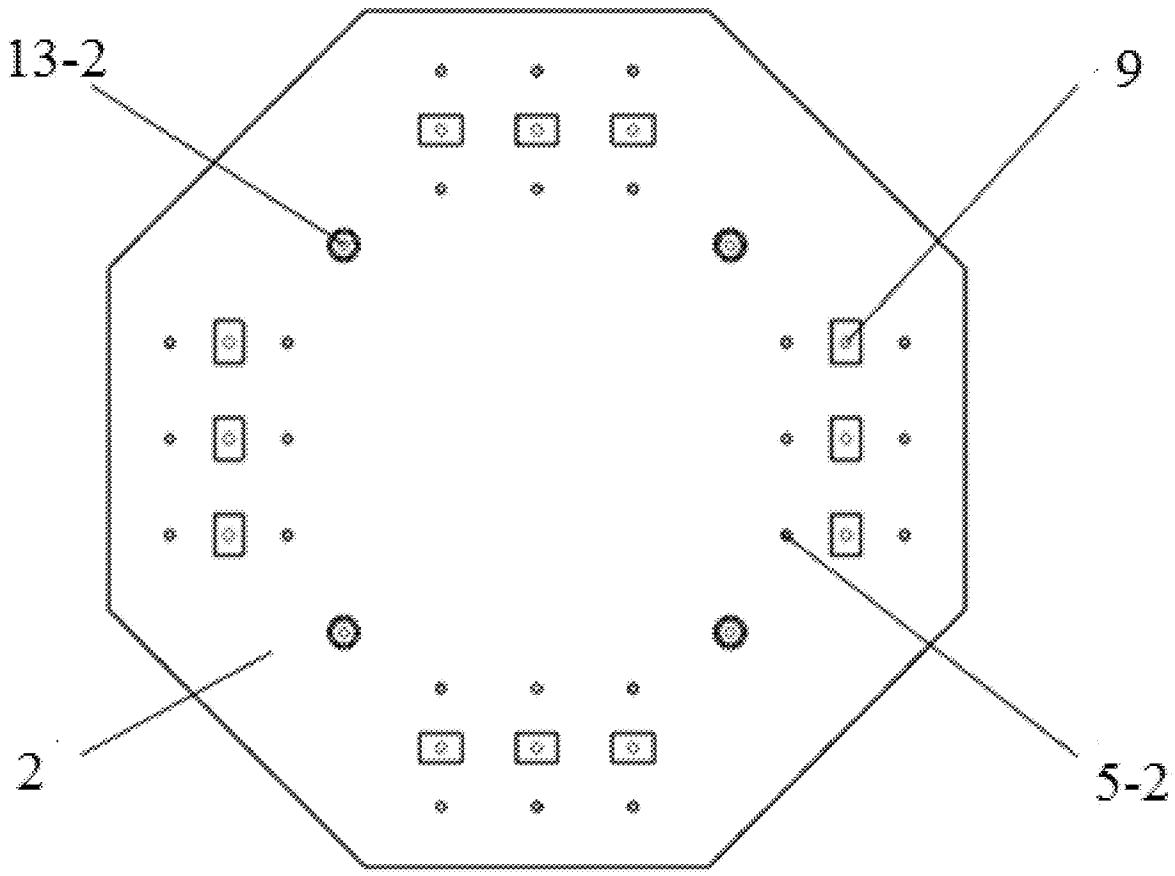
FIG. 4 depicts a structural schematic diagram of the lower connecting plate in the present invention.
Figure 5:
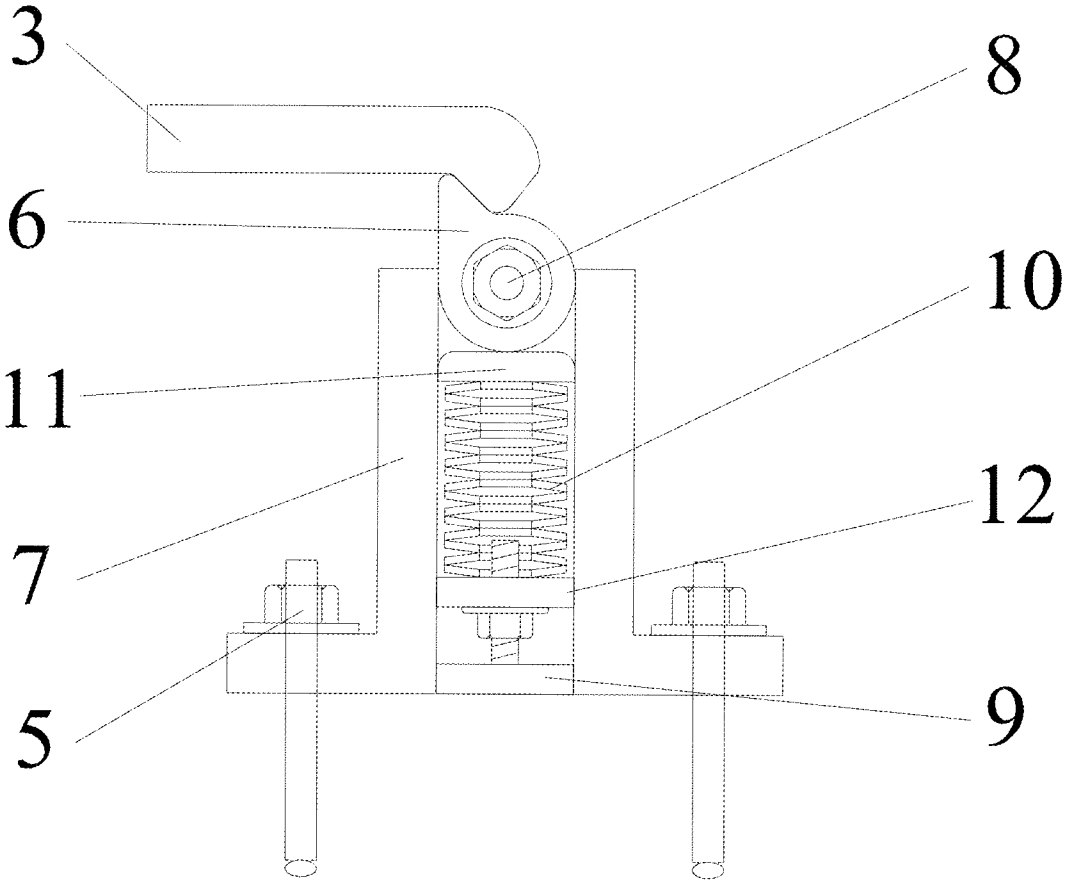
FIG. 5 depicts a structural schematic diagram of the wind stiffness adjuster in the present invention.
Figure 9:
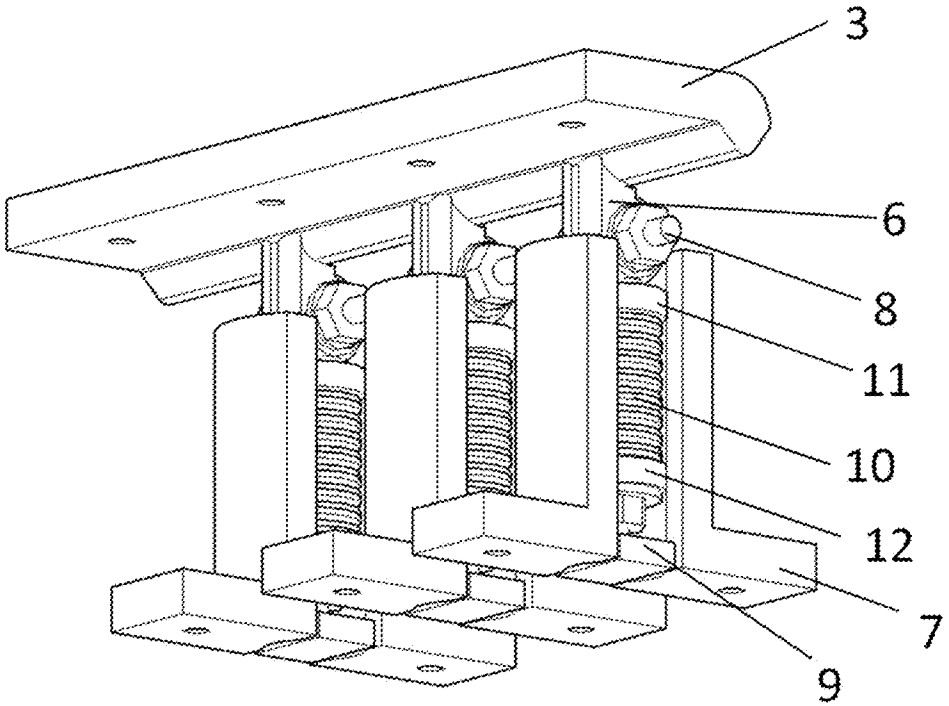
FIG. 9 depicts a 3D schematic diagram of the wind stiffness adjuster in the present invention.
Figure 10:
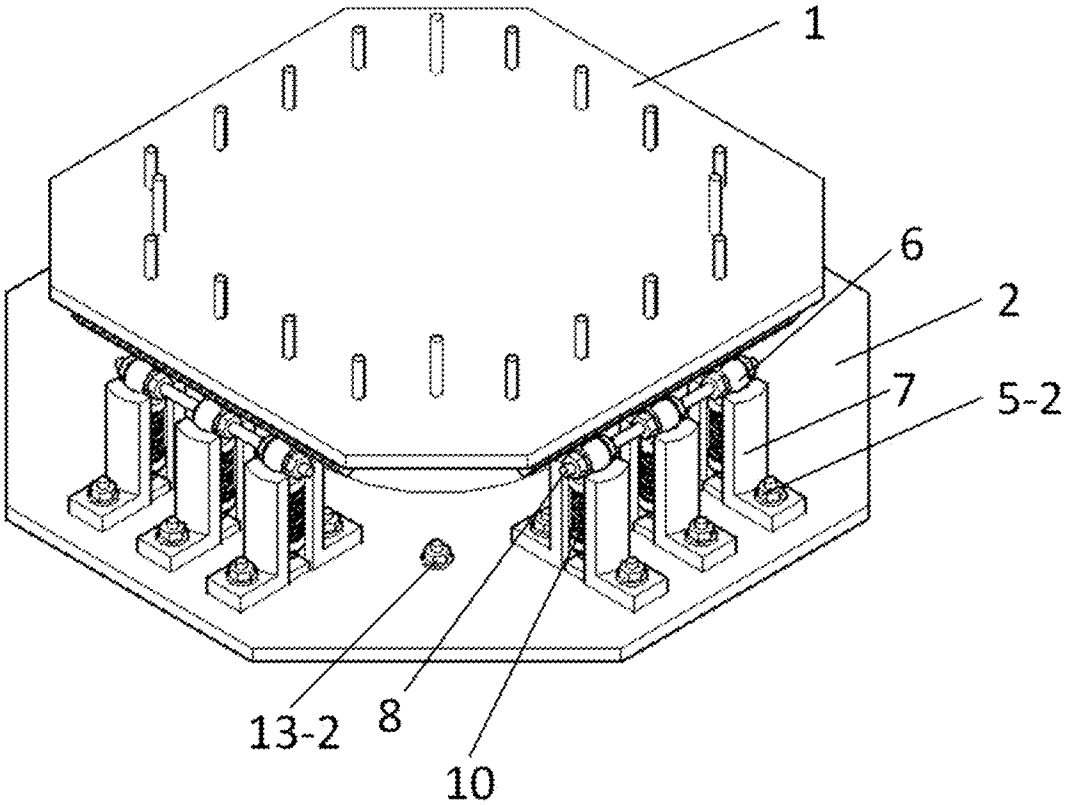
FIG. 10 depicts a 3D schematic diagram of the present invention.

As shown in FIGS. 1-10, a damage-free engagement device for enhanced wind-resistance of base-isolated structures is shown in the above FIGs, and it includes the following components: a rubber seismic isolation support 4 located between a super-structure and a sub-structure of the seismic isolation layer, equipped with an upper connection plate 1 and a lower connection plate 2 on an upper surface and a lower surface thereof respectively for connecting the super-structure and the sub-structure of the seismic isolation layer. There are twelve sets of wind stiffness adjusters arranged around the rubber seismic isolation support 4, with three sets of wind stiffness adjusters arranged in parallel on each side of the rubber seismic isolation support 4. The upper connection plate 1 is fixed to the super-structure of the seismic isolation layer by the first anchor bolt 13-1, and the lower connection plate 2 is fixed to the sub-structure of the seismic isolation layer by the second anchor bolt 13-2. The wind stiffness adjuster, as shown in FIGS. 5 and 9, includes a horizontal sliding bearing plate 3 fixed on the upper connection plate 1 by the first connecting bolt 5-1, a vertical guide groove 7 fixed on the lower connection plate 2 by the second fixed bolt 5-2, a bird beak plate 6, a disk spring assembly 10, and a stiffness adjustment bolt 9 arranged in the vertical guide groove 7 from top to bottom. The bird beak plate 6 is able to slide up and down along the vertical guide groove 7, and the upper hook structure of the bird beak plate 6 hooks and engages with the horizontal sliding bearing plate 3. The upper surface and the lower surface of the disk spring assembly 10 are provided with an upper steel washer 11 and a lower steel washer 12, respectively. The upper steel washer 11 is in contact with the bottom of the bird beak plate 6, and the lower steel washer 12 is connected to the stiffness adjustment bolt 9, which is for adjusting the compression state of the disk spring assembly 10. The stiffness adjustment bolt 9 shown in FIG. 8 includes a bolt end plate 9-1 positioned on the vertical guide groove 7, a bolt rod 9-2 fixed to the bolt end plate 9-1, and a washer 9-3 and a nut 9-4 successively threaded through the bolt rod 9-2 from top to bottom. The center of the lower steel washer 12 is provided with a hole for the bolt rod 9-2 to pass through and connect with the disk spring assembly 10 through the nut 9-4. When the bolt rod 9-2 passes through the lower steel washer 12 to fix the stiffness adjustment bolt 9 to the disk spring assembly 10, the washer 9-3 is further in contact with the lower steel washer 12, and the bolt end plate 9-1 is in contact with the bottom of the vertical guide groove 7.

Figure 6:
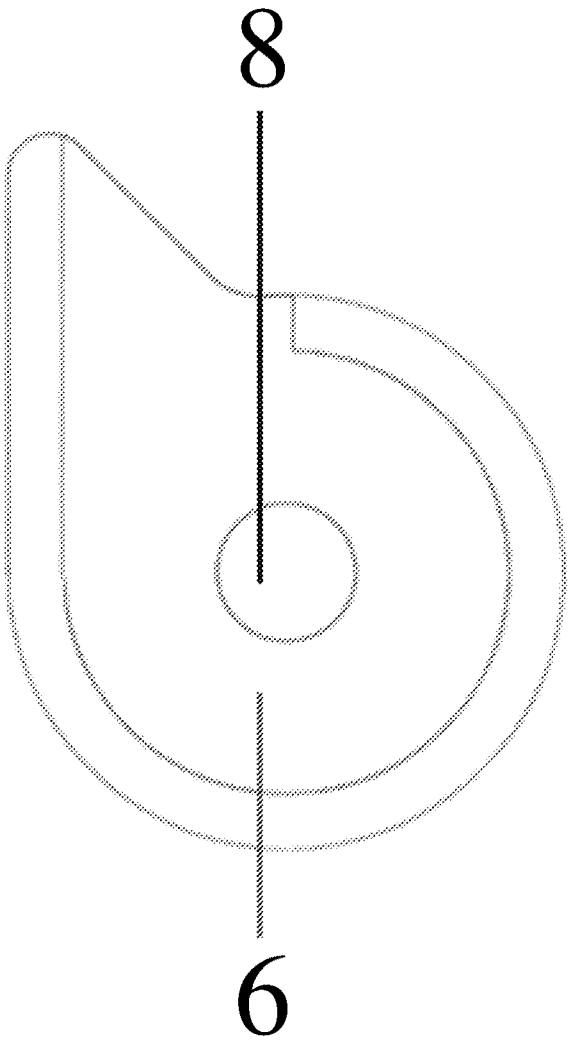
FIG. 6 depicts a structural schematic diagram of the beak plate in the present invention.
Figure 7:
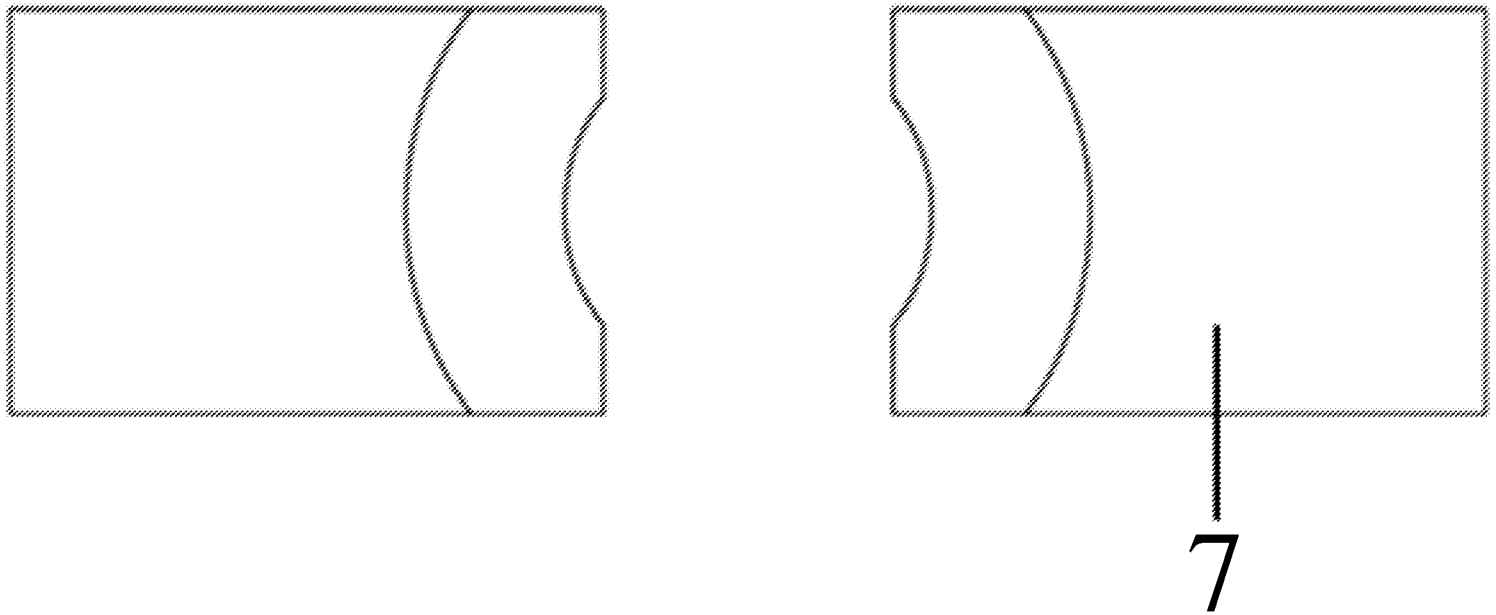
FIG. 7 depicts a top-down view schematic diagram of the vertical guide groove structure in the present invention.
Figure 8:
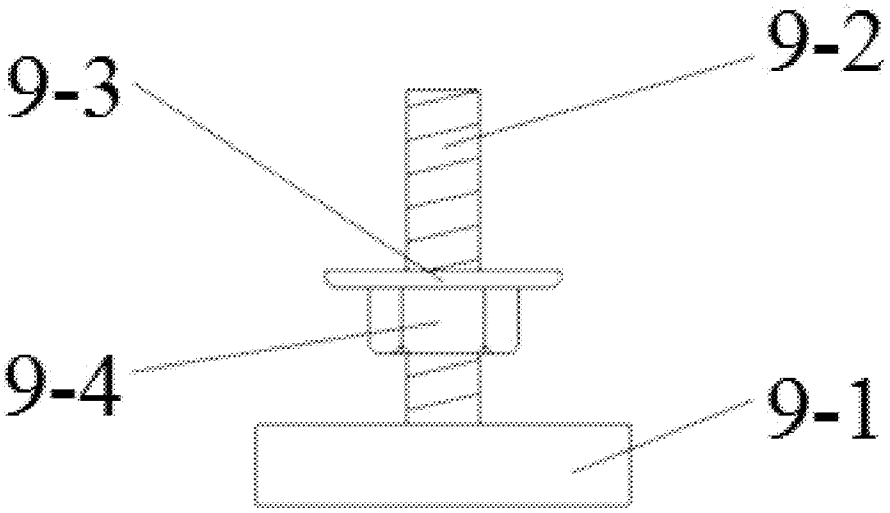
FIG. 8 depicts a structural schematic diagram of the stiffness adjustment bolt in the present invention.

The bird beak plate 6 shown in FIG. 6 is comma-shaped and includes a circular structure and an upper hook structure that is integral with the circular structure. The horizontal sliding bearing plate 3 is an L-shaped structure, including a horizontal bar and a protrusion located at the end of the horizontal bar. The upper hook structure of the bird beak plate 6 engages and hooks onto the protrusion of the horizontal sliding bearing plate 3. When the upper hook structure of the bird beak plate 6 hooks onto the protrusion of the horizontal sliding bearing plate 3, the interface between the contacting surfaces forms an inclined slope surface. The central circular structure of the bird beak plate 6 is also provided with a hole for the horizontal connecting rod 8 to pass through and connect the three sets of wind stiffness adjusters arranged in parallel. Two side walls of the vertical guide groove 7 shown in FIG. 7 are non-equal in length and include a long side wall and a short side wall. The highest point of the long side wall is lower than the lowest point of the horizontal sliding bearing plate 3. The long side wall further slides and fits with the upper hook structure of the bird beak plate 6, while the short side wall slides and fits with the circular structure of the bird beak plate 6.

The principle of operation of the present invention is as follows: The compressive characteristics of the disc spring assembly 10 and the horizontal resistance generated by the engagement and hooking between the bird beak plate 6 and the horizontal sliding bearing plate 3 provide horizontal stiffness to resist the bending moment and horizontal shear load borne by the seismic isolation layer under wind load. This effectively solves the wind resistance issue in isolation structures. Under certain seismic actions, the bird beak plate 6 is subjected to horizontal thrust, which compresses the disc spring assembly 10 in the vertical guide groove 7 and disengages from the horizontal sliding bearing plate 3. Consequently, the wind stiffness adjuster is disengaged and no longer restrains the horizontal displacement of the seismic isolation layer. The rubber seismic isolation support 4 begins to function. The initial stiffness of the wind stiffness adjuster does not affect the horizontal isolation effect of the rubber seismic isolation support 4, thus avoiding the issue of excessive horizontal stiffness in the isolation support caused by considering wind-induced vibration in existing designs. After an earthquake, the stiffness adjustment bolt 9 can be turned to release the pressure on the disc spring assembly 10. Then, the horizontal sliding bearing plate 3 is adjusted to re-engage and hook onto the bird beak plate 6, and finally, the stiffness adjustment bolt 9 is tightened to restore the working state of the wind stiffness adjuster quickly. This process ensures that no component replacement or plastic damage occurs throughout the entire process of the "wind lock-isolation unlock-wind lock" mechanism.

The installation method of the present invention device is as follows:

(1) Fix the upper connecting plate 1 to the super-structure of the seismic isolation layer using the first anchor bolt 13-1, and fix the lower connecting plate 2 to the sub-structure of the seismic isolation layer using the second anchor bolt 13-2. Install the rubber seismic isolation support 4 at the central position between the upper connecting plate 1 and the lower connecting plate 2. The upper connecting plate 1 is fixed to the horizontal sliding bearing plate 3 using the first connecting bolt 5-1, and the lower connecting plate 2 is fixed to the vertical guide groove 7 using the second connecting bolt 5-2.

(2) Weld the stiffness adjustment bolt 9 to the bottom of the vertical guide groove 7. Place the lower steel washer 12 on the stiffness adjustment bolt 9 inside the vertical guide groove 7, and then sequentially place the disc spring assembly 10, upper steel washer 11, and bird beak plate 6 on top of the lower steel washer 12. Adjust their positions to ensure that the bird beak plate 6 engages and hooks onto the horizontal sliding bearing plate 3.

(3) Turn the stiffness adjustment bolt 9 to adjust the compression state of the disc spring assembly 10, ensuring that the bird beak plate 6 engages and hooks onto the horizontal sliding bearing plate 3. The installation is completed.

The description of the above embodiments is provided to enable those skilled in the art to understand and use the invention. It will be apparent to those skilled in the art that various modifications can be made to these embodiments and that the general principles described herein can be applied to other embodiments without departing from the inventive concept. Therefore, the present invention is not limited to the above embodiments, and any improvements and modifications made by those skilled in the art based on the disclosure of the present invention should be within the scope of the present invention.

What is claimed is:

1. A damage-free engagement device for enhanced wind-resistance of base-isolated structures, comprising:

a rubber seismic isolation support (4) placed between a super-structure and a sub-structure of a seismic isolation layer, with an upper and a lower surfaces thereof respectively equipped with an upper connecting plate (1) and a lower connecting plate (2) configured to connect the super-structure and the sub-structure of the seismic isolation layer;

a plurality of wind-resistance stiffness adjusters disposed between the upper connecting plate (1) and the lower connecting plate (2) and surrounding the rubber seismic isolation support (4), each wind-resistance stiffness adjuster comprises a horizontal sliding bearing plate (3) fixed on the upper connecting plate (1), a vertical guide groove (7) defined by two side walls disposed on the lower connecting plate (2), and components arranged within the vertical guide groove (7), comprising a bird beak plate (6) and a disc spring group (10) in sequence from top to bottom, the bird beak plate (6) is configured to slide up and down along the vertical guide groove (7), and an upper hook structure thereof fits and hooks with the horizontal sliding bearing plate (3), wherein the bird beak plate (6) has a comma-shaped body defined by a circular structure and the upper hook structure integrated with the circular structure, and the horizontal sliding bearing plate (3) has an L-shaped structure, and comprises a horizontal bar and protrusions located at an end of the horizontal bar, and the upper hook structure of the bird beak plate (6) engages with and hooks onto the protrusions of the horizontal sliding bearing plate (3) such that an interface therebetween forms an inclined slope surface.

2. The damage-free engagement device for enhanced wind-resistance of base-isolated structures according to claim 1, wherein a central part of the circular structure of the bird beak plate (6) has a hole through which a horizontal connecting rod (8) passes to connect the plurality of wind-resistance stiffness adjusters set side by side.

3. The damage-free engagement device for enhanced wind-resistance of base-isolated structures according to claim 1, wherein the two side walls of the vertical guide groove (7) are non-equal in length and comprise a longer side wall and a shorter side wall, and highest point of the longer side wall is lower than lowest point of the horizontal sliding bearing plate (3).

4. The damage-free engagement device for enhanced wind-resistance of base-isolated structures according to claim 3, wherein the longer side wall further fits slidingly with the upper hook structure of the bird beak plate (6), and the shorter side wall fits slidingly with the circular structure of the bird beak plate (6).

5. The damage-free engagement device for enhanced wind-resistance of base-isolated structures according to claim 1, wherein upper and lower surfaces of the disc spring group disposed with an upper steel washer (11) and a lower steel washers (12), the upper steel washers (11) is in contact with a bottom of the bird beak plate (6), and the lower steel washers (12) is equipped with a stiffness adjustment bolt (9) to adjust a compression state of the disc spring group (10).

6. The damage-free engagement device for enhanced wind-resistance of base-isolated structures according to claim 5, wherein the stiffness adjustment bolt (9) comprises a bolt end plate (9-1) positioned on the vertical guide groove (7), a bolt (9-2) fixed to the bolt end plate (9-1), and a washer (9-3) and a nut (9-4) threaded sequentially through the bolt (9-2) from top to bottom.

7. The damage-free engagement device for enhanced wind-resistance of base-isolated structures according to claim 6, wherein a center of the lower steel washer (12) has a hole, allowing the bolt (9-2) to pass through the lower steel washer (12) and be securely connected to the disc spring group (10) through the nut (9-4).

8. The damage-free engagement device for enhanced wind-resistance of base-isolated structures according to claim 6, wherein when the bolt (9-2) passes through the lower steel washer (12) to secure the stiffness adjustment bolt (9) to the disc spring group (10), the washer (9-3) further fits against the lower steel washer (12), and the bolt end plate (9-1) fits against the bottom of the vertical guide groove (7).

* * * * *